US006717361B2

(12) United States Patent
Burrows

(10) Patent No.: US 6,717,361 B2
(45) Date of Patent: Apr. 6, 2004

(54) MEMBRANOUS EL SYSTEM IN UV-CURED URETHANE ENVELOPE

(75) Inventor: Kenneth Burrows, Pilot Point, TX (US)

(73) Assignee: MRM Acquisitions, LLC, Dallas, TX (US)

( * ) Notice: Subject to any disclaimer, the term of this patent is extended or adjusted under 35 U.S.C. 154(b) by 73 days.

(21) Appl. No.: 09/974,941

(22) Filed: Oct. 10, 2001

(65) Prior Publication Data

US 2002/0041153 A1 Apr. 11, 2002

Related U.S. Application Data

(60) Provisional application No. 60/239,508, filed on Oct. 11, 2000.

(51) Int. Cl.[7] ..... H01J 1/60; H05B 33/04

(52) U.S. Cl. ..... 313/512; 313/506; 428/917

(58) Field of Search ..... 313/512, 504, 313/506, 509; 428/917

(56) References Cited

U.S. PATENT DOCUMENTS

| | | | |
|---|---|---|---|
| 3,875,449 | A | 4/1975 | Byler et al. |
| 4,104,555 | A | 8/1978 | Fleming |
| 4,548,646 | A | 10/1985 | Mosser et al. |
| 4,647,337 | A | 3/1987 | Simpoulos et al. |
| 4,684,353 | A | 8/1987 | deSouza |
| 4,816,717 | A | 3/1989 | Harper et al. |
| 4,853,079 | A | 8/1989 | Simopoulos et al. |
| 4,853,594 | A | 8/1989 | Thomas |
| 4,999,936 | A | 3/1991 | Calamia et al. |
| 5,041,326 | A | 8/1991 | Schroeder et al. |
| 5,184,969 | A | 2/1993 | Sharpless et al. |
| 5,243,060 | A | 9/1993 | Barton et al. |
| 5,336,345 | A | 8/1994 | Gustafson et al. |
| 5,475,574 | A | 12/1995 | Chien |

(List continued on next page.)

FOREIGN PATENT DOCUMENTS

| | | |
|---|---|---|
| EP | 0 166 534 A1 | 1/1986 |
| EP | 0 286 748 A1 | 10/1988 |
| JP | 60-224702 | 10/1985 |
| JP | 63-160622 | 1/1990 |

OTHER PUBLICATIONS

PCT Written Opinion mailed May 26, 1998—International Application No. PCT/US97/09112.

PCT Written Opinion mailed Sep. 22, 1998—International Application No. PCT/US97/09112.

(List continued on next page.)

*Primary Examiner*—Ashok Patel
(74) *Attorney, Agent, or Firm*—Locke Liddell & Sapp LLP

(57) ABSTRACT

A membranous electroluminescent structure including membranous envelope layers encapsulating electroluminescent layers. The envelope layers comprise a UV-curable ink, such as a urethane acrylate/acrylate monomer. When deployed in layer form and exposed to UV radiation, the ink cures in a few seconds without any appreciable layer height shrinkage. Manufacturing cycle time is significantly optimized over traditional heat curing processes. The resulting membranous UV-cured EL structure nonetheless has all the advantages of membranous EL structures.

16 Claims, 2 Drawing Sheets

U.S. PATENT DOCUMENTS 5,491,377 A 2/1996 Janusauskas
5,496,427 A 3/1996 Gustafson et al.
5,559,680 A 9/1996 Tabanera
5,565,733 A 10/1996 Krafcik et al.
5,567,040 A 10/1996 Tabanera
5,570,945 A 11/1996 Chien et al.
5,611,621 A 3/1997 Chien
5,688,038 A 11/1997 Chien
5,701,189 A 12/1997 Koda et al.
5,704,705 A 1/1998 Chien
5,746,501 A 5/1998 Chien
5,770,920 A 6/1998 Eckersley et al.
5,772,924 A 6/1998 Hayashi et al.
5,794,366 A 8/1998 Chien
5,806,960 A 9/1998 Chien
5,810,467 A 9/1998 Hurwitz
5,811,930 A 9/1998 Krafcik et al.
5,836,671 A 11/1998 Chien
5,856,029 A 1/1999 Burrows
5,856,030 A 1/1999 Burrows
5,856,031 A 1/1999 Burrows
5,860,727 A 1/1999 Chien
5,865,523 A 2/1999 Chien
5,871,271 A 2/1999 Chien
5,879,069 A 3/1999 Chien
5,921,653 A 7/1999 Chien
5,947,580 A 9/1999 Chien
5,980,976 A 11/1999 Burrows
6,144,157 A * 11/2000 Rogers et al. ..... 313/512
6,198,217 B1 * 3/2001 Suzuki et al. ..... 313/512
6,261,633 B1 7/2001 Burrows
6,270,834 B1 8/2001 Burrows
6,271,631 B1 8/2001 Burrows
6,309,764 B1 10/2001 Burrows
6,379,743 B1 * 4/2002 Lee et al. ..... 427/66
6,512,250 B1 * 1/2003 Koyama et al. ..... 313/506

OTHER PUBLICATIONS

Samsung Chemical Company, "Sam Sung Co.'s Technology Service About Screen Printing," downloaded Mar. 16, 1998 from the Internet at http://www.sgiakor.org.inf.htm, 7 pages.
International Publication No. WO 95/27417, published Oct. 19, 1995; Tseng–Lu Chien, "Shoe With An EL Light Strip".
International Publication No. WO 86/03460, published Jun. 19, 1986; Luminescent Electronics, Inc., "Electroluminescent Panels."
Supplementary European Search Report mailed Jun. 15, 2000 filed in counterpart EP Application No. EP 97953511.
International Publication No. WO 00/29131, published May 25, 2000; E.L. Specialists, Inc.., "Translucent Layer Including Metal/Metal Oxide Dopant Suspended in Gel Resin."
International Publication No. WO 01/51281 A1, published Jul. 19, 2001; E.L. Specialists, Inc., "Alerting System Using Elastomeric EL Lamp Structure."

* cited by examiner

MEMBRANOUS EL SYSTEM IN UV-CURED URETHANE ENVELOPE

RELATED APPLICATIONS

This application claims the benefit of U.S. Provisional Application No. 60/239,508, filed Oct. 11, 2000.

This application is further related to commonly-assigned U.S. patent application TRANSLUCENT LAYER INCLUDING METAL/METAL OXIDE DOPANT SUSPENDED IN GEL RESIN, Ser. No. 09/173,521, filed Oct. 15, 1998, now U.S. Pat. No. 6,261,633, the disclosure of which patent is incorporated herein by reference.

This application is also related to commonly-assigned U.S. patent application METHOD FOR CONSTRUCTION OF ELASTOMERIC ELECTROLUMINESCENT LAMP, Ser. No. 09/173,404, filed Oct. 15, 1998, now U.S. Pat. No. 6,270,834, the disclosure of which patent is also incorporated herein by reference.

TECHNICAL FIELD OF THE INVENTION

This invention relates, in general, to electroluminescent systems, and more specifically to a membranous electroluminescent structure comprising an electroluminescent system encapsulated in a UV-cured urethane envelope.

BACKGROUND OF THE INVENTION

An embodiment of the invention taught by related application Ser. No. 09/173,521 is directed to an electroluminescent ("EL") system having a unitary carrier whose layers form a monolithic structure. A preferred unitary carrier in this system is a vinyl resin. One of the advantages of this monolithic electroluminescent system is that the layers thereof may be deployed as inks onto a wide variety of substrates using screen printing or other suitable methods. The disclosure of Ser. No. 09/173,521 is incorporated herein by reference.

This vinyl-based monolithic structure is also disclosed in an exemplary embodiment of the membranous electroluminescent devices taught by related application Ser. No. 09/173,404. Specifically, Ser. No. 09/173,404 teaches exemplary use of the vinyl-based monolithic structure as an electroluminescent laminate deployed between two membranous urethane envelope layers. The disclosure of Ser. No. 09/173,404 is incorporated herein by reference.

While the electroluminescent systems described in Ser. Nos. 09/173,521 and 09/173,404 have been found to be serviceable, it will be appreciated that yet further advantages of monolithic structure will be obtained if the electroluminescent laminate in Ser. No. 09/173,404 had layers suspended in a urethane carrier. In this way, the membranous electroluminescent devices disclosed in Ser. No. 09/173,404 would comprise layers in the electroluminescent laminate that were in monolithic unity with surrounding urethane envelope layers. Co-pending, concurrently-filed patent application MEMBRANOUS MONOLITHIC EL STRUCTURE WITH URETHANE CARRIER, Ser. No. 09/974,918, addresses this need by providing, in an exemplary embodiment, a membranous monolithic urethane electroluminescent structure whose monolithic phase comprises a series of contiguous electroluminescent layers deployed using a unitary vinyl gel resin carrier that is catalyzed to transform into a unitary urethane carrier during curing. The disclosure of MEMBRANOUS MONOLITHIC EL SYSTEM WITH URETHANE CARRIER, Ser. No. 09/974,918, is incorporated herein by reference.

Regardless of whether the layers of the electroluminescent system cure to a vinyl or urethane (or any other polymer), however, the surrounding membranous envelope layers have been heat cured up until now. Typically, in the membranous lamp disclosed in application Ser. No. 09/173,404, a heat cure of about 105° C. for about 35 minutes per deployed urethane envelope layer is required. In a structure having envelope layer thickness built up from several individual urethane layer deployments, the curing phase now requires multiples of 35-minute cures, thereby adding significantly to the manufacturing cycle time (and cost) for the structure.

Moreover, heat curing has been found to cause shrinkage of the height of individually deployed layers. Thus, even more layers are required to be deployed to build up an overall envelope layer height, extending the manufacturing cycle time for curing even further.

There is therefore a need in the art for an alternative to heat curing the envelope layers in a membranous EL structure. Advantageously, such an alternative will not only reduce curing cycle times, but also minimize individual deployed layer height shrinkage.

SUMMARY OF THE INVENTION

The present invention addresses the above-described problems by curing the envelope layers in a membranous EL structure using ultra-violet ("UV") radiation. In a presently preferred embodiment, the envelope layers comprise a UV-curable ink such as a urethane acrylate/acrylate monomer. When deployed in layer form and exposed to UV radiation, the ink cures in a few seconds without any appreciable layer height shrinkage. Manufacturing cycle time is significantly optimized over traditional heat curing processes. The resulting membranous UV-cured EL structure nonetheless has all the advantages of membranous EL structures as disclosed in application Ser. No. 09/173,404 and co-pending concurrently-filed application Ser. No. 09/974,918.

The reduction of curing cycle times for individually deployed layers from minutes to seconds further enables manufacturing to convert from a batch curing system to a continuous curing system. A preferred embodiment of the present invention may be cured on a UV curing conveyor system as is well known in the art. This is in distinction to heat curing "batches" of EL structures layer by layer in an oven, as is generally undertaken in current manufacturing. Further optimization of manufacturing cycle time results. Not only is there a reduction in curing cycle time because each envelope layer now cures in seconds rather than minutes, there is also an optimization of handling time through use of a continuous system.

Accordingly, a technical advantage of the present invention is that curing cycle times for the inventive membranous envelope inks are dramatically reduced.

A further technical advantage of the present invention is that deployed layer height shrinkage is also reduced. As a result, fewer individually deployed layers are necessary to achieve a desired overall membranous envelope layer thickness.

A further technical advantage of the present invention is that continuous curing techniques are now available to manufacturing processes, in contrast to the batch techniques that are currently available.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Figure 1:
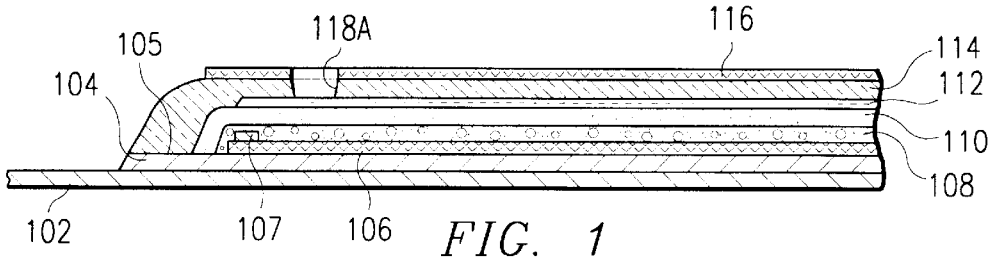
FIG. 1 is a cross-sectional view of a preferred embodiment of a membranous EL lamp according to the present invention.
Figure 2:
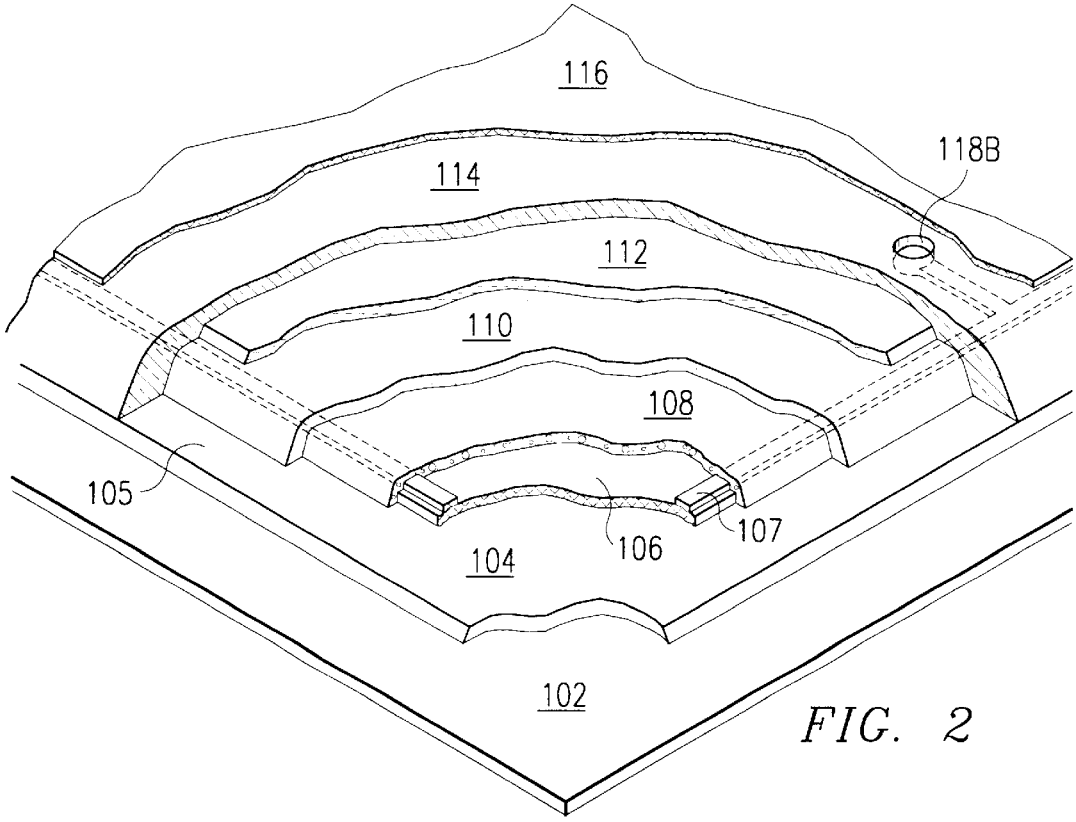
FIG. 2 is a perspective view of the cross-sectional view of FIG. 1.

FIG. 1 illustrates a cross-sectional view of a preferred embodiment of an EL lamp as a membranous structure according to the present invention. FIG. 2 is a perspective view of FIG. 1. It will be seen that all layers on FIGS. 1 and 2 are deployed on transfer release paper 102. In a preferred embodiment, transfer release paper 102 is as manufactured by Midland Paper—Aquatron Release Paper. It will also be understood that as an alternative to paper, transfer release film or silicon-coated polyester sheet, for example, may be used consistent with the present invention. Alternatively, the EL lamp may be deployed directly onto a permanent substrate.

All subsequent layers as shown on FIGS. 1 and 2 (and subsequent Figures) are advantageously deployed by screen printing processes known in the art. Once again, however, it will be understood that the present invention is not limited to providing membranous EL lamps whose layers have been applied solely by screen printing, and other methods of applying layers may be used to construct membranous EL lamps consistent with the present invention.

There now follows a discussion of first UV-cured envelope layer 104 as shown on FIGS. 1 and 2. It will be appreciated, however, that the following discussion of first UV-cured envelope layer 104 is equally applicable to and descriptive of second UV-cured envelope layer 114, also shown on FIGS. 1 and 2.

First UV-cured envelope layer 104 is printed down onto transfer release paper 102. It may be advantageous to print first UV-cured envelope layer 104 down in several intermediate layers to achieve a desired overall combined thickness. Printing first UV-cured envelope layer 104 down in a series of intermediate layers also facilitates dying or other coloring of particular layers to achieve a desired natural light appearance of the EL lamp. In a presently preferred embodiment, first UV-cured envelope layer 104 is a UV-curable urethane acrylate/acrylate monomer such as Nazdar 651818PS. This is a UV-curable urethane ink intended for screen printing. The Nazdar 651818PS product comes pre-mixed with a UV-sensitive catalyst that initiates hardening and cross-linking when exposed to UV radiation. When cured, this polymer exhibits the desired membranous characteristics for the envelope layer, being chemically stable with other components of the EL structure, and also extremely malleable and ductile. This polymer is further well disposed to be deployed in multiple layers to reach a monolithic final thickness when cured. This polymer is also substantially colorless and generally clear, and so layers thereof are further well disposed to receive dying or other coloring treatments (as will be further described below) to provide an EL structure whose appearance in natural light is designed to complement its active light appearance in subdued light. Finally, this polymer, being a urethane, is compatible with EL structures such as are disclosed in exemplary embodiments in co-pending application Ser. No. 09/974,918, in which urethane layers catalyzed from vinyl layers combine with contiguous urethane envelope layers to form a membranous monolithic urethane EL structure.

It will be appreciated, however, that the present invention is not limited to enablement by the Nazdar 651818PS product, nor even to a urethane product. Any UV-curable polymer may be used to enable the invention with equivalent effect, so long as the resulting, cured polymer has the desired membranous envelope characteristics and is chemically stable with neighboring EL layers.

When embodied as a layer of UV-curable urethane acrylate/acrylate monomer such as Nazdar 651818PS, first UV-cured envelope layer 104 on FIGS. 1 and 2 is preferably deployed as a series of individual layers in the range of 20 to 40 microns thick. An overall thickness of 50 to 100 microns is generally serviceable for first UV-cured envelope layer 104 in most applications.

Individual layers are deployed serially using screen printing or other suitable techniques. Each individual layer is cured by UV radiation before the next layer is deployed. Curing is preferably done using a conventional UV-curing conveyor, thereby enabling a continuous manufacturing process. The UV-curing conveyor may use conventional mercury vapor lamps as a source of UV radiation.

Obviously some experimentation and adjustment is required to determine the optimal UV radiation duration and intensity to achieve a desired layer cure. Variables such as the frequency and intensity of the UV radiation source, the distance from the source to the layer to be cured, the thickness of the layer to be cured, and the precise UV-curable polymer used will affect the determination of an optimal exposure time. Such experimentation is normal and known to be expected in any UV-curing conveyor process. By way of example, however, it has been found that a burst of UV radiation for 3 seconds at a frequency of 320–390 nm imparts approximately 500–600 mJ of intensity, which is satisfactory to cure a layer of Nazdar 651818PS that is approximately 20 microns thick.

It will also be understood that the rapid speed of UV-curing also cures individual layers without appreciable loss of layer height.

Referring back now to FIGS. 1 and 2, it will be seen that first UV-cured envelope layer 104 is printed down onto transfer release paper 102 so as to provide a border 105 clear of the edge of EL system layers 106–112. This is so as to provide a zone on which second UV-cured envelope layer 114 can bond to completely seal and crosslink the EL system in a membranous monolithic urethane structure, the aspects of which will be described in greater detail below.

An EL system is next printed down onto first UV-cured envelope layer 104. On FIGS. 1 and 2 it will be seen that the EL lamp is being constructed "face down." It will be appreciated, however, that this is not a limit on the present invention, which may just as easily be constructed "face up."

EL layers 106–112 on FIGS. 1 and 2 may be deployed as any electroluminescent system which, in combination with first and second UV-cured envelope layers 104 and 114, may provide an EL structure with membranous properties. For example, EL systems such as are disclosed in applications Ser. Nos. 09/173,521 and 09/173,404 may be used in conjunction with first and second UV-cured envelope layers 104 and 114. Alternatively, an EL system having layers transformed by catalyst from vinyl form to urethane form during curing may also be used in conjunction with first and second UV-cured envelope layers 104 and 114 to form a membranous monolithic urethane EL structure.

In such a membranous monolithic urethane EL structure, one or more, and advantageously all of the layers comprising translucent electrode layer 106, luminescent layer 108, dielectric layer 110, and back electrode layer 112 are deployed in the form of active ingredients (hereafter also referred to as "dopants") initially suspended in a unitary vinyl resin carrier in gel form. It will be understood that although the preferred embodiment herein discloses exemplary use of a unitary vinyl gel carrier in which all layers are suspended, alternative embodiments of the present invention may have less than all neighboring layers suspended therein.

It will be understood that the initial deployment of dopants suspended in a vinyl resin in gel form results in reduced manufacturing costs by virtue of economies associated with being able to purchase larger quantities of carrier, as well as storing, mixing, handling, curing and cleaning similar suspensions.

Research has also revealed that the initial use of a carrier in gel form results in further advantages. The viscosity and encapsulating properties of a gel result in better suspension of particulate dopants mixed into the gel. This improved suspension requires less frequent, if any, agitation of the compound to keep the dopants suspended. Experience reveals that less frequent agitation results in less spoilage of the compounds during the manufacturing process.

Furthermore, vinyl resin in gel form is inherently less volatile and less noxious than the liquid-based cellulose, acrylic and polyester-based resins currently used in the art. In a preferred embodiment of the present invention, the vinyl gel utilized as the unitary carrier is an electronic grade vinyl ink such as SS24865, available from Acheson. Such electronic grade vinyl inks in gel form have been found to maintain particulate dopants in substantially full suspension throughout the manufacturing process. Moreover, such electronic grade vinyl inks are ideally suited for layered application using screen printing techniques standard in the art.

In a monolithic urethane embodiment, once the vinyl gel resin carrier has been doped with a particular active ingredient to form an ink, a catalyst is also mixed into the ink in quantities dependent on the vinyl gel resin content of the ink. This catalyst facilitates transformation of the vinyl carrier into a urethane during curing. Thus, referring again to FIG. 1 and also to FIG. 2, when the EL layers 106, 108, 110 and 112 are cured, neighboring urethane layers crosslink both with themselves and with surrounding envelope layers 104 and 114 to bring enhanced monolithic properties to the finished laminate in urethane form. As taught by U.S. patent application Ser. No. 09/173,404, the finished laminate in urethane form also has membranous properties with attendant high flexibility.

The preferred catalyst used in the monolithic urethane embodiments disclosed herein is 1, 6 Hexamethylene Diisocyanate Based Polyisocyanate, also known as Polymeric Hexamethylene Diisocyanate, from the Aliphantic Polyisocyanate family of polymers. This application will in future refer to this polymer as "PHD" when describing its exemplary use in embodiments of the invention set forth below. PHD is commercially available from Bayer Corporation under the product name Desmodur N-100, product code D-113. It will be understood, however, that the monolithic urethane embodiments described herein are not limited to PHD as a catalyst, and that any catalyst having the same catalytic properties as PHD transforming vinyl into urethane may be used.

Referring again to FIGS. 1 and 2, translucent electrode layer 106 is first printed down onto first UV-cured envelope layer 104. Translucent electrode 106 comprises the unitary carrier doped with a suitable translucent electrical conductor in particulate form. In a preferred embodiment of the present invention, this dopant is indium-tin-oxide (ITO) in powder form.

The design of translucent electrode layer 106 must be made with reference to several variables. It will be appreciated that the performance of translucent electrode layer 106 will be affected by not only the concentration of ITO used, but also the ratio of indium-oxide to tin in the ITO dopant itself. In determining the precise concentration of ITO to be utilized in translucent electrode layer 106, factors such as the size of the electroluminescent lamp and available power should be considered. The more ITO used in the mix, the more conductive translucent electrode layer 106 becomes. This is, however, at the expense of translucent electrode layer 106 becoming less translucent. The less translucent the electrode is, the more power that will be required to generate sufficient electroluminescent light. On the other hand, the more conductive translucent electrode layer 106 is, the less resistance EL system 106–112 will have as a whole, and so less the power that will be required to generate electroluminescent light. It will be therefore readily appreciated that the ratio of indium-oxide to tin in the ITO, the concentration of ITO in suspension and the overall layer thickness must all be carefully balanced to achieve performance that meets design specifications.

Experimentation has shown that a suspension of 25% to 50%, by weight, of ITO powder containing 90% indium-oxide and 10% tin, with 50% to 75% electronic grade vinyl ink in gel form, when applied by screen printing to a thickness of approximately 9 microns, results in a serviceable translucent electrode layer 106 for most applications. Advantageously, the ITO powder is mixed with the vinyl gel in a ball mill for approximately 24 hours. The ITO powder is available by name from Arconium, while the vinyl gel is again SS24865 from Acheson. Alternatively, a suitable premixed ITO ink in vinyl gel form is available from Acheson as product EL020. It will be further understood that the dopant in translucent electrode layer 106 is not limited to ITO, but may also be any other electrically conductive dopant with translucent properties.

In a monolithic urethane embodiment, catalyst is then added to the ITO ink after ball milling, or alternatively catalyst is added direct to the ink if obtained pre-mixed. The requisite amount of catalyst by weight is preferably stirred by hand into the ink using a polypropylene paddle or spatula. Stirring should continue until the catalyst appears to the eye to be well dispersed within the ink.

The catalyzed ink may then be deployed as translucent electrode layer 106 using screen printing or other suitable methods. Unused catalyzed ink should be refrigerated at about 5° C. When refrigerated, such unused ink has been found to be serviceable for several days after initial addition of catalyst.

The amount of catalyst to be added varies according to the ink composition of ITO and vinyl resin carrier. Although experimentation is required to get optimum results when ITO powder is ball-milled into vinyl gel, the optimum weight of PHD catalyst will be in the range of 3%–5% by weight of the weight of electronic grade vinyl ink (such as Acheson SS24865) used in the ball-milled mix. Alternatively, for an exemplary "short cut" using pre-mixed ink, it has been found that serviceable results are achievable by adding PHD to the Acheson pre-mixed ITO ink product EL020 in the ratio of 0.45 grams of PHD to 100 grams of EL020.

Returning to FIGS. 1 and 2, it will be understood that front bus bar 107, as illustrated in FIGS. 1 and 2, is deployed on translucent electrode layer 106 to provide electrical contact between translucent electrode layer 106 and a power source (not illustrated). In a preferred embodiment, front bus bar 107 is placed in contact with translucent electrode layer 106 subsequent to the deployment of translucent electrode 106 on first UV-cured envelope layer 104. Although not a specific requirement of the present invention, experimentation has shown improved performance when front bus bar 107 is deployed on top of translucent electrode layer 106 rather than the reverse (translucent electrode layer 106 deployed on top of front bus bar 107). This is because when translucent electrode layer 106 is deployed on top of the front bus bar 107, the translucent electrode layer 106 has been found to tend to cure to form a barrier inhibiting conductivity with front bus bar 107 previously laid. This phenomenon appears not to occur in the reverse, however, and so front bus bar 107 is preferably deployed onto translucent electrode layer 106.

If front bus bar 107 is a thin metallic bar, it is also preferable, although not required, to apply front bus bar 107 to translucent electrode layer 106 prior to curing to allow front bus bar 107 to become part of the monolithic structure of the present invention, thereby optimizing electrical contact between front bus bar 107 and translucent electrode layer 106. In other embodiments, however, front bus bar 107 may be an ink deployed by screen printing or other suitable methods. In such cases, the ink may be formulated and deployed as described below with respect to back electrode layer 112. Note that as described below with reference to back electrode layer 112, however, use of the catalyst in a front bus bar ink has been found in practice not be workable. The electrode content of the ink tends to over-react, causing the ink to become unuseable after only a few minutes.

Luminescent layer 108 (advantageously a phosphor/barium titanate mixture) is then printed down onto translucent electrode layer 106 and over front bus bar 107. Luminescent layer 108 comprises of the unitary carrier doped with electroluminescent grade encapsulated phosphor. Experimentation has revealed that a suspension containing 50% phosphor, by weight, to 50% electronic grade vinyl ink in gel form, when applied to a thickness of approximately 25 to 35 microns, results in a serviceable luminescent layer 108. The phosphor is advantageously mixed with the vinyl gel for approximately 10–15 minutes. Mixing should preferably be by a method that minimizes damage to the individual phosphor particles. Suitable phosphor is available by name from Osram Sylvania, and the vinyl gel may again be SS24865 from Acheson.

It shall be appreciated that the color of the light emitted will depend on the color of phosphor used in luminescent layer 108, and may be further varied by the use of dyes. Advantageously, a dye of desired color is mixed with the vinyl gel prior to the addition of the phosphor. For example, rhodamine may be added to the vinyl gel in luminescent layer 108 to result in a white light being emitted.

Experimentation has also revealed that suitable admixtures, such as barium-titanate, improve the performance of luminescent layer 108. As noted above, admixtures such as barium-titanate have a smaller particle structure than the electroluminescent grade phosphor suspended in luminescent layer 108. As a result, the admixture tends to unify the consistency of the suspension, causing luminescent layer 108 to go down more uniformly, as well as assisting even distribution of the phosphor in suspension. The smaller particles of the admixture also tend to act as an optical diffuser which remediates a grainy appearance of the luminescing phosphor. Finally, experimentation also shows that a barium-titanate admixture actually may enhance the luminescence of the phosphor at the molecular level by stimulating the photon emission rate.

The barium-titanate admixture used in the preferred embodiment is the same as the barium-titanate used in dielectric layer 110, as described below. As noted below, this barium-titanate is available by name in powder form from Tam Ceramics. Again, the vinyl gel carrier may be SS24865 from Acheson. In the preferred embodiment, the barium-titanate is pre-mixed into the vinyl gel carrier, advantageously in a ratio of 70%, by weight, of the vinyl gel, to 30% of the barium-titanate. This mixture is blended in a ball mill for at least 48 hours. Alternatively, suitable pre-mixed barium-titanate-loaded luminescent inks in vinyl gel form are available from Acheson as products EL035, EL035A and EL033. If luminescent layer 108 is to be dyed, such dyes should be added to the vinyl gel carrier prior to ball mill mixing.

In a monolithic urethane embodiment, catalyst is added to the luminescent ink (whether barium-titanate-loaded or not) after ball milling, or alternatively catalyst is added direct to the ink if obtained pre-mixed. As with the ITO ink described above, the requisite amount of catalyst by weight is preferably stirred by hand into the ink using a polypropylene paddle or spatula. Stirring should continue until the catalyst appears to the eye to be well dispersed within the ink.

The catalyzed ink may then be deployed as luminescent layer 108 using screen printing or other suitable methods. As before, unused catalyzed ink may be refrigerated and re-used for several days without appreciable loss of performance.

The amount of catalyst to be added again varies according to the ink composition of phosphor and vinyl resin carrier. Although experimentation is required to get optimum results when phosphor powder (with or without barium titanate) is ball-milled into vinyl gel, the optimum weight of PHD catalyst will again be in the range of 3%–5% by weight of the weight of electronic grade vinyl ink (such as Acheson SS24865) used in the ball-milled mix. Alternatively, for an exemplary "short cut" using pre-mixed barium-titanate-loaded luminescent inks, it has been found that serviceable results are achievable by adding PHD to the Acheson pre-mixed luminescent ink products EL035, EL035A and EL033 the ratio of 0.22 grams of PHD to 100 grams of pre-mixed luminescent ink product.

Returning again now to FIGS. 1 and 2, dielectric layer 110 (advantageously barium titanate) is printed down onto luminescent layer 108. Dielectric layer 110 comprises the unitary carrier doped with a dielectric in particulate form. In a preferred embodiment, this dopant is barium-titanate powder. Experimentation has shown that a suspension containing a ratio of 50% to 75%, by weight, of barium-titanate powder to 50% to 25% electronic grade vinyl ink in gel form, when applied by screen printing to a thickness of approximately 15 to 35 microns, results in a serviceable dielectric layer 110. The barium-titanate is advantageously mixed with the vinyl gel for approximately 48 hours in a ball mill. Suitable barium-titanate powder is available by name from Tam Ceramics, and the vinyl gel may be SS24865 from Acheson, as noted before. Alternatively, a suitable pre-mixed barium-titanate ink in vinyl gel form is available from Acheson as product EL040. It will be further appreciated that the doping agent in dielectric layer 110 may also be selected from other dielectric materials, either individually or in a mixture thereof. Such other materials may include titanium-dioxide, or derivatives of mylar, teflon, or polystyrene.

In a monolithic urethane embodiment, catalyst is then added to the dielectric ink after ball milling, or alternatively catalyst is added direct to the ink if obtained pre-mixed. As with previous inks described above, the requisite amount of catalyst by weight is preferably stirred by hand into the ink using a polypropylene paddle or spatula. Stirring should continue until the catalyst appears to the eye to be well dispersed within the ink.

The catalyzed ink may then be deployed as dielectric layer 110 using screen printing or other suitable methods. As before, unused catalyzed ink may be refrigerated and re-used for several days without appreciable loss of performance.

The amount of catalyst to be added again varies according to the ink composition of dielectric dopant and vinyl resin carrier. Although experimentation is required to get optimum results when a dielectric dopant (such as barium titanate) is ball-milled into vinyl gel, the optimum weight of PHD catalyst will again be in the range of 3%–5% by weight of the weight of electronic grade vinyl ink (such as Acheson SS24865) used in the ball-milled mix. Alternatively, for an exemplary "short cut" using pre-mixed dielectric inks, it has been found that serviceable results are achievable by adding PHD to the Acheson pre-mixed dielectric ink product EL040 in the ratio of 0.345 grams of PHD to 100 grams of EL040.

It has also been found that yet further "ruggedization" of electroluminescent structures of the present invention may be achieved by adding urethane to the dielectric ink that will be deployed as dielectric layer 110. For example, urethane such as Nazdar product DA170 "Clear T Grade" polyurethane may be added to the Acheson pre-mixed dielectric ink product EL040. The DA170 Clear T Grade polyurethane additive is first mixed with its DA176 catalyst in a ratio of about 3 parts polyurethane to one part catalyst. The catalyzed additive is then mixed with EL040 after the dielectric ink has been mixed with PHD catalyst. The polyurethane additive may be mixed with the dielectric ink in proportions ranging from 25% additive/75% ink to 75% additive/25% ink, as measured by weight before any catalyst (DA176 or PHD) is added.

The addition of the urethane to the dielectric ink greatly improves the mechanical strength of dielectric layer 110, when deployed and cured. Crosslinking of dielectric layer 110 with neighboring urethane layers is also improved. Further, the urethane content tends to reduce any tendency of dielectric layer 110 towards electrical breakdown. The higher the urethane content, the more rugged the cured dielectric ink becomes.

Note, however, that increasing urethane content in the dielectric ink reduces the operational capacitance of the overall electroluminescent structure, thereby reducing, for example, the potential brightness of a lamp in which it may be deployed. When selecting a level of urethane content as an additive in dielectric layer 110, therefore, designers need to balance the need for potential ruggedness and strength with the electroluminescent capability of the structure.

Returning again to FIGS. 1 and 2, back electrode layer 112 is printed down onto dielectric layer 110. Back electrode layer 112 initially comprises the unitary vinyl carrier doped with an ingredient to make the suspension electrically conductive. In a preferred embodiment, the doping agent in back electrode layer 112 is silver in particulate form. It shall be understood, however, that the doping agent in back electrode layer 112 may be any electrically conductive material including, but not limited to, gold, zinc, aluminum, graphite and copper, or combinations thereof. Experimentation has shown that proprietary mixtures containing silver/graphite suspended in electronic grade vinyl ink as available from Grace Chemicals as part numbers M4200 and M3001-1RS respectively, are suitable for use as back electrode layer 112. Alternatively, a suitable pre-mixed silver ink in vinyl gel form is available from Acheson as product EL010. Research has further revealed that layer thicknesses of approximately 8 to 12 microns give serviceable results. Layers may be deposited in such thicknesses using standard screen printing techniques.

Although in theory catalyst could be added to a back electrode ink to enable carrier transformation from vinyl to urethane, it has been found that use of such a catalyst in practice is not workable. It has been found that the catalyst tends to over-react with the back electrode dopant in the ink. Rapid cross-linking ensues rendering the ink unuseable within minutes of the catalyst being added.

Turning again to FIGS. 1 and 2, second UV-cured envelope layer 114 is then printed down onto back electrode layer 112. It will be seen from FIGS. 1 and 2 that EL system layers 106–112 are advantageously printed down leaving border 105 clear. This allows second UV-cured envelope layer 114 to be printed down to bond to first UV-cured envelope layer 104 around border 105, thereby (1) sealing the EL system in an envelope so as to isolate the EL system electrically, (2) allowing second UV-cured envelope layer 114 to crosslink with the ends of cured urethane layers in EL system 106–112, and (3) making the entire laminate substantially moisture proof. As noted above, and according to the invention, second UV-cured envelope layer 114 is preferably made from the same material, and is preferably manufactured and UV-cured in the same way as first UV-cured envelope layer 104. Further, also as noted above, second UV-cured envelope layer 114 may also be deployed in a series of intermediate layers to achieve a desired thickness.

As noted above, a laminate comprising first UV-cured envelope layer 104, urethane layers in EL system 106–112, and second UV-cured envelope layer 114, now provides a monolithic urethane structure. The catalyst added to the EL system layers 106–110 when initially deployed in vinyl resin gel form is disposed to transform, upon curing, the EL system layers 106–110 into urethane form. These transformed urethane EL system layers bond and crosslink with first and second UV-cured envelope layers 104 and 114, which were deployed in native urethane form. The resulting urethane laminate has increased rugged qualities, as well as membranous properties, as described in application Ser. No. 09/173,404 and co-pending application Ser. No. 09/974,918.

The final (top) layer illustrated on FIGS. 1 and 2 is an optional adhesive layer 116. As already described, one application of the elastomeric EL lamp of the present invention is as a transfer affixed to a substrate. In this case, the transfer may be affixed using a heat adhesive, although other affixing means may be used, such as contact adhesive. Heat adhesive has the advantage that it may be printed down using the same manufacturing processes as other layers of the assembly, and then the transfer may be stored or stocked, ready to be affixed subsequently to a substrate using a simple heat press technique. In this case, as illustrated on FIGS. 1 and 2, adhesive layer 116 is printed down onto second UV-cured envelope layer 114.

Of course, in other applications of the present invention where the elastomeric EL lamp is a self-contained component of another product, the optional adhesive layer 116 will likely not be necessary.

A further feature illustrated on FIGS. 1 and 2 is the pair of rear contact windows 118A and B. Clearly, in order for electric power to be brought in to energize EL system 106–112, rear contact window 118A is required through adhesive layer 116 and second UV-cured envelope layer 114 to reach back electrode layer 112. Similarly, a further window is required to reach front bus bar 107 through adhesive layer 116, second UV-cured envelope layer 114, back electrode layer 112, dielectric layer 110 and luminescent layer 108. This further window is not illustrated on FIG. 1, being omitted for clarity, but may be seen on FIG. 2 as item 118B penetrating all layers through to front bus bar 107 and thereby facilitate the supply of electric power thereto.

Figure 3:
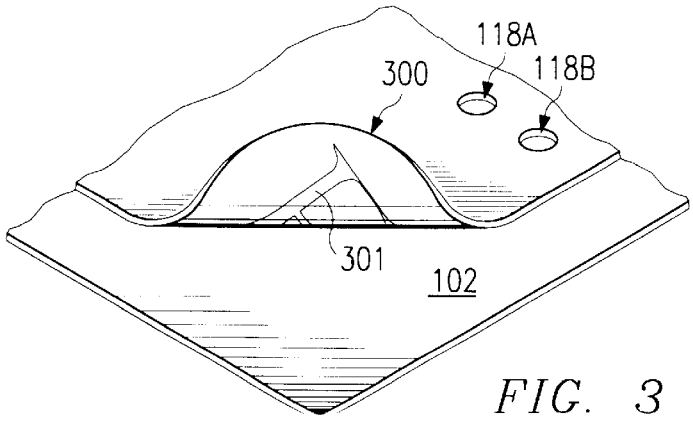
FIG. 3 is a perspective view of an membranous EL lamp of the present invention being peeled off transfer release paper 102.

FIG. 3 illustrates the entire assembly as described substantially above after completion and upon readiness to be removed from transfer release paper 102. Membranous EL lamp 300 (comprising layers and components 104–116 as shown on FIGS. 1 and 2) is being peeled back from transfer release paper 102 in preparation for affixation to a substrate. Back and front contact windows 118A and 118B are also shown.

It will also be appreciated (although not illustrated) that the present invention provides further manufacturing economies over traditional EL lamp manufacturing processes when large number of the same design lamp are required. Screen printing techniques allow multiple EL lamps 300 to be constructed simultaneously on one large sheet of transfer release paper 102. The location of these lamps 300 may be registered on the single sheet of release paper 102, and then simultaneously punched out with a suitable large punch. The individual lamps 300 may then be stored for subsequent use.

As noted above, in accordance with the present invention, the front appearance of elastomeric EL lamp 300 in natural light may also be designed and prepared using dying or other techniques on selected intermediate layers of first UV-cured envelope layer 104. In accordance with such techniques, FIG. 3 also depicts a first portion of logo 301 being revealed as elastomeric EL lamp 300 is being peeled back. Features and aspects of a preferred preparation of logo 301 will be discussed in greater detail below.

Figure 4:
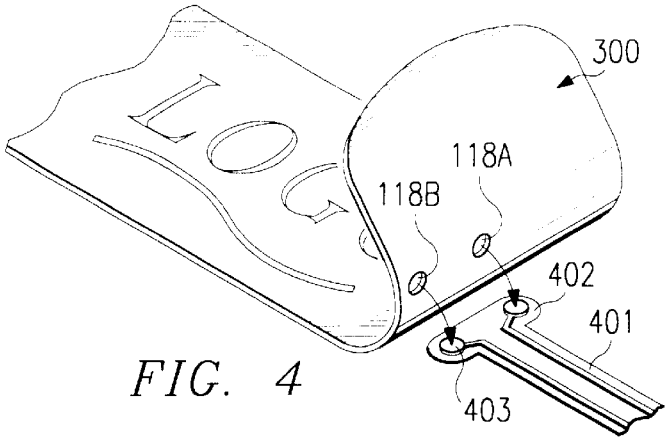
FIG. 4 depicts a preferred method of enabling electric power supply to an membranous EL lamp of the present invention.

First, however, there follows further discussion of two alternative preferred means for providing electric power to the elastomeric EL lamp of the present invention. With reference to FIG. 4, elastomeric EL lamp 300 will be seen right side up and rolled back to reveal back and front contact windows 118A and 118B. Electric power is being brought in from a remote source via flexible bus 401, which may, for example, be a printed circuit of silver printed on polyester, such as is known in the art. Alternatively, flexible bus 401 may comprise a conductor (such as silver) printed onto a thin strip of polyurethane. Flexible bus 401 terminates at connector 402, whose size, shape and configuration is predetermined to mate with back and front contact windows 118A and 118B. Connector 402 comprises two contact points 403, one each to be received into back and front contact windows 118A and 118B respectively, and by mechanical pressure, contact points 403 provide the necessary power supply to the EL system within elastomeric EL lamp 300.

In a preferred embodiment, contact points 403 comprise electrically-conductive silicon rubber contact pads to connect the terminating ends of flexible bus 401 to the electrical contact points within back and front contact windows 118A and 118B. This arrangement is particularly advantageous when elastomeric EL lamp 300 is being affixed to a substrate by heat adhesive. The heat press used to affix the transfer to the substrate creates mechanical pressure to enhance electrical contact between the silicon rubber contact pads and electrical contact surfaces on contact points 403 and within contact windows 118A and 118B. Electrical contact may be enhanced yet further by applying silicon adhesive between contact surfaces. Enabling silicon rubber contact pads are manufactured by Chromerics, and are referred to by the manufacturer as "conductive silicon rubbers." An enabling silicon adhesive is Chromerics 1030.

A particular advantage of using silicon rubber contact pads is that they tend to absorb relative shear displacement of elastomeric EL lamp 300 and connector 402. Compare, for example, an epoxy glued mechanical joint. The adhesion between transfer 300 and connector 402 would be inherently very strong, but so rigid and inflexible that relative shear displacement between transfer 300 and connector 402 would be transferred directly into either or both of the two components. Eventually, one or other of the epoxy-glued interfaces (epoxy/transfer 300 or epoxy/connector 402) would likely shear off.

In contrast, however, the resilience of the silicon rubber contact pads disposes the silicon rubber interface provided thereby to absorb such relative shear displacement without degeneration of either the pads or the electromechanical joint. The chance is thus minimized for elastomeric EL lamp 300 to lose power prematurely because an electrical contact point has suffered catastrophic shear stresses.

Figure 5:
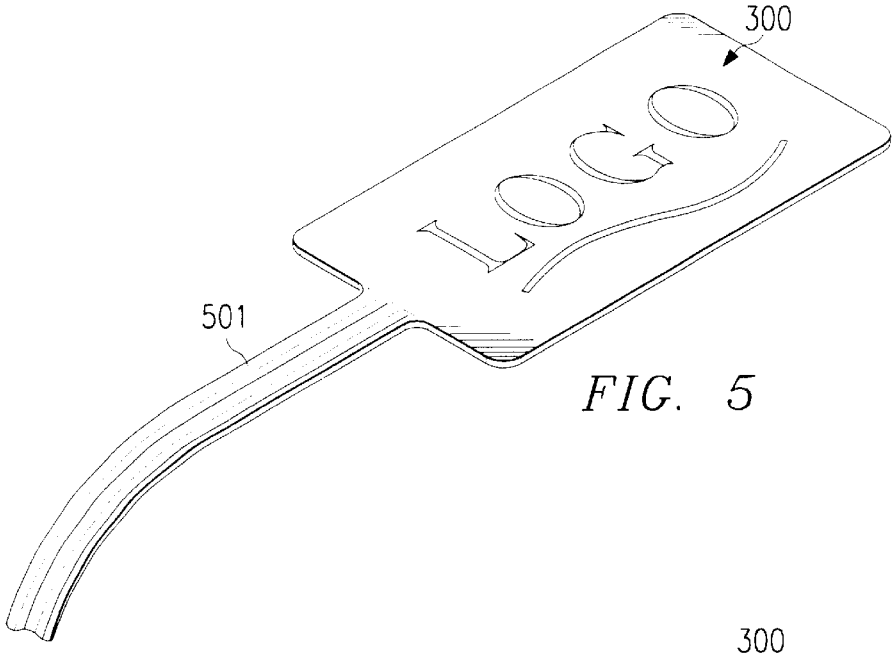
FIG. 5 depicts an alternative preferred method of enabling electric power supply to an membranous EL lamp of the present invention.

An alternative preferred means for providing electric power to the EL lamp transfer of present invention is illustrated on FIG. 5. In this case, when front bus bar 107 and back electrode layer 112 are printed down (as described above with reference to FIG. 1) extensions thereto are also printed down beyond the boundaries of elastomeric EL lamp 300 and onto trailing printed bus 501. A suitable substrate for trailing printed bus 501 may be, for example, a "tail" of polyurethane that extends from either first or second envelope layers 104 or 114. Additionally, it will be seen that, if desired, the conductors of trailing printed bus 501 may be sealed within trailing extensions of both first and second UV-cured envelope layers 104 and 114. Electric power may then be connected remotely from transfer 300 using trailing printed bus 501.

It should be noted that the power supplies in a preferred embodiment use battery/invertor printed circuits with extremely low profiles. For example, a silicon chip-based invertor provides an extremely low profile and size. These power supply components can thus be hidden easily, safely and unobtrusively in products on which elastomeric EL lamps of the present invention are being used. For example, in garments, these power supply components may be hidden effectively in special pockets. The pockets can be sealed for safety (e.g. false linings). Power sources such as lithium 6-volt batteries, standard in the art, will also offer malleability and ductility to enable the battery to fold and bend with the garment. It will be further seen that flexible bus 401 such as is illustrated on FIG. 4, or trailing printed bus 501 such as illustrated on FIG. 5, may easily be sealed to provide complete electrical isolation and then conveniently hidden within the structure of a product.

Turning now to printing techniques, the present invention also discloses improvements in EL lamp printing techniques to develop EL lamps (including elastomeric EL lamps) whose passive natural light appearance is designed to complement the active electroluminescent appearance. Such complementing includes designing the passive natural light appearance of the EL lamp to appear substantially the same as the electroluminescent appearance so that, at least in terms of image and color hue, the EL lamp looks the same whether unlit or lit. Alternatively, the lamp may be designed to display a constant image, but portions thereof may change hue when lit as opposed to unlit. Alternatively again, the outer appearance of the EL lamp may be designed to change when lit.

Printing techniques that may be combined to enable these effects include (1) varying the type of phosphor (among colors of light emitted) used in electroluminescent layer 108, (2) selecting dyes with which to color layers printed down above electroluminescent layer 108, and (3) using dot sizing printing techniques to achieve gradual changes in apparent color hue of both lit and unlit EL lamps.

Figure 6:
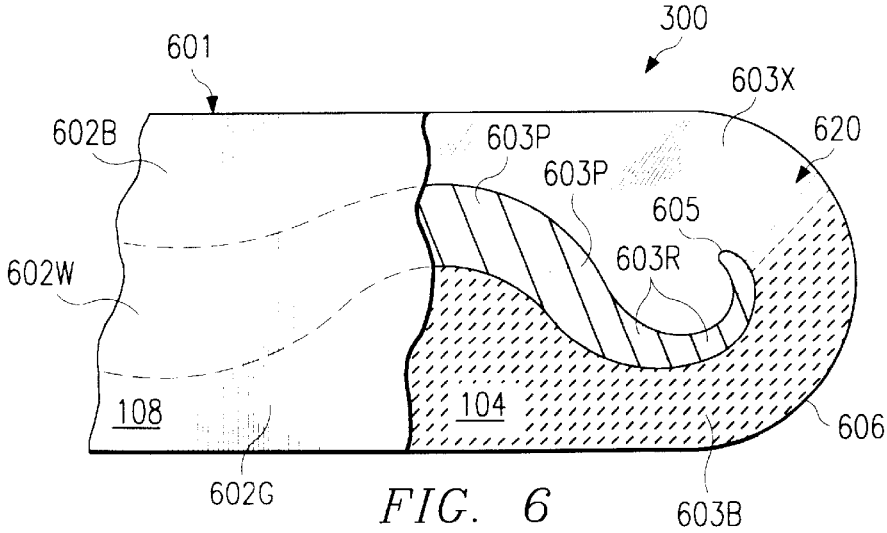
FIG. 6 depicts zones of membranous EL lamp 300, with a cutaway portion 601, supporting disclosure herein of various colorizing techniques of layers to create selected unlit/lit appearances.

FIG. 6 illustrates these techniques. A cutaway portion 601 of elastomeric EL lamp 300 reveals electroluminescent layer 108. In cutaway portion 601, three separate electroluminescent zones 602B, 602W and 602G have been printed down, each zone printed using an electroluminescent material containing phosphor emitting a different color of light (blue, white and green respectively). It will be understood that screen printing techniques known in the art may enable the print down of the three separate zones 602B, 602W and 602G. In this way, various zones emitting various light colors may be printed down and, if necessary, combined with zones emitting no light (i.e. no electroluminescent material printed down) to portray any design, logo or information to be displayed when electroluminescent layer 108 is energized.

The outward appearance of electroluminescent layer 108 when energized may then be modified further by selectively colorizing (advantageously, by dying) subsequent layers interposed between electroluminescent layer 108 and the front of the EL lamp. Such selective colorization may be further controlled by printing down colorized layers only in selected zones above electroluminescent layer 108.

Referring again to FIG. 6, elastomeric EL lamp 300 has first envelope layer 104 disposed over electroluminescent layer 108, and as described above with reference to FIGS. 1 and 2, first UV-cured envelope layer 104 may be printed down to a desired thickness by overlaying a plurality of intermediate layers. One or more of these layers may include envelope layer material dyed to a predetermined color and printed down so that said colorization complements the expected active light appearance from beneath. The result is a desired overall combined effect when the EL lamp is alternatively lit and unlit.

For example, on FIG. 6, suppose that zone 603B is tinted blue, zone 603X is untinted, zones 603R are tinted red and zones 603P are tinted purple. The natural light appearance of elastomeric EL lamp 300 would be, substantially, to have a red and purple striped design 605 with a blue border 606. Red zones 603R and purple zones 603P would modify the white hue of zone 602W beneath, untinted zone 603X would leave unmodified the beige hue of zone 602B beneath, and blue zone 603B would modify the light green/beige hue of zone 602G beneath to give an appearance of a slightly darker blue. It will be appreciated that the blue tint in zone 603B may be further selected so that, when combined with the green of zone 602G beneath, the natural light appearance is substantially the same blue.

When elastomeric EL lamp 300 was energized, however, zones 603R, 603P and 603X would remain red, purple and blue respectively, while zone 603B would turn turquoise as the strong green phosphor light from beneath was modified by the blue tint of zone 603B. Thus, an exemplary effect is created wherein part of the image is designed to be visually the same whether elastomeric EL lamp 300 is lit or unlit, while another part of the image changes appearance upon energizing.

It will thus be appreciated that limitless design possibilities arise for interrelating the lit and unlit appearances of the lamp by printing down various colorized phosphor zones in combination with various tinted zones above. It will be understood that such lit/unlit appearance design flexibility and scope is not available in traditional EL manufacturing technology, wherein it is difficult to print variously colored "zones" with precision, or as intermediate layers within a monolithic thickness.

It will be further emphasized that in the tinting technique described above, fluorescent-colored dyes are advantageously blended into the material to be tinted, in contrast to use of, for example, a paint or other colorizing layer. Such dying facilitates achieving visually equivalent color hue in reflected natural light and active EL light. Color blending may be enabled either by "trial and error" or by computerized color blending as is known in the art more traditionally, for example, with respect to blending paint colors.

With further reference to FIG. 6, there is further illustrated a transition zone 620 between zones 603B and 603X. It is intended that transition zone 620 represents a zone in which the darker blue hue of zone 603B (when elastomeric EL lamp 300 is energized) transforms gradually into the lighter blue hue of zone 603X.

It is standard in the print trade to "dot print." Further, this "dot printing" technique will be understood to be easily enabled by screen printing. It is known that "dot printing" enables the borders of two printed neighboring zones to be "fused" together to form a zone in apparent transition. This is accomplished by extending dots from each neighboring zone into the transition zone, decreasing the size and increasing the spacing of the dots as they are extended into the transition zone. Thus, when the dot patterns in the transition zones are overlapped or superimposed, the effect is a gradual change through the transition zone from one neighboring zone into the next.

It will be understood that this effect may easily be enabled on the present invention. With reference again to FIG. 6, a dyed layer providing a particular hue in zone 603B may be printed down with dots extending into transition zone 620 where said dots reduce size and increase spacing as they extend into transition zone 620. A dyed layer providing a particular hue in zone 603X may then be printed down on top with dots extending into transition zone 620 in a reciprocal fashion. The net effect, in both natural and active light, is for transition zone 620 to exhibit a gradual transformation from one hue to the next.

Although the present invention and its advantages have been described in detail, it should be understood that various changes, substitutions and alterations can be made herein without departing from the spirit and scope of the invention as defined by the appended claims.

I claim:

1. An electroluminescent structure, comprising:

an electroluminescent system; and a UV-curable envelope, the UV-curable envelope comprises a laminate of cured layers, and in which selected ones of the cured layers are cured using UV radiation, the electroluminescent system disposed within the envelope, the electroluminescent system and the envelope in combination having membranous properties.

2. The invention of claim 1, in which selected ones of the cured layers comprise layers of UV-curable urethane about 20 microns thick, and in which said layers of UV-curable urethane are cured by a bursts of about UV radiation for about 3 seconds at about 500–600 mJ of intensity.

3. An electroluminescent structure, comprising:

an electroluminescent system; and a UV-curable envelope, the UV-curable envelope comprises a laminate of cured layers, and in which selected ones of the cured layers comprise UV-curable urethane cured by UV radiation, the electroluminescent system disposed within the envelope, the electroluminescent system and the envelope in combination having membranous properties.

4. The invention of claim 3, in which the UV-curable urethane comprises a urethane acrylate/acrylate monomer.

5. An electroluminescent structure, comprising:

an electroluminescent system, and a UV-curable envelope, the electroluminescent system comprises a laminate of cured layers, selected ones of the cured layers originally deployed using a screen printing process, the electroluminescent system disposed within the envelope, the electroluminescent system and the envelope in combination having membranous properties.

6. An electroluminescent structure, comprising:

an electroluminescent system;

a UV-curable envelope, the UV-curable envelope and the electroluminescent system cure to form a substantially monolithic mass;

the substantially monolithic mass includes layers of cured urethane; and the electroluminescent system disposed within the envelope, the electroluminescent system and the envelope in combination having membranous properties.

7. The invention of claim 6, in which the layers of cured urethane include layers originally deployed including an uncured catalyzed vinyl, the catalyzed vinyl including an uncured vinyl vehicle mixed with a catalyst, the catalyst encouraging transformation of the uncured vinyl vehicle to a urethane vehicle during curing thereof.

8. The invention of claim 7, in which the layers originally deployed including an uncured catalyzed vinyl are selected from the group consisting of:

(a) a translucent electrode layers;

(b) a dielectric layer;

(c) an electroluminescent layer; and (d) a non-translucent electrode layer.

9. The invention of claim 7, in which the layers of cured urethane also include layers originally deployed as an uncured urethane.

10. The invention of claim 7, in which the catalyst comprises polymeric hexamethylene diisocyanate.

11. A membranous electroluminescent structure, comprising:

an electroluminescent system;

a UV-curable envelope including a laminate of cured layers, the cured layers comprising a UV-curable urethane cured by UV radiation;

the electroluminescent system disposed within the envelope, the electroluminescent system and the envelope in combination having membranous properties.

12. The invention of claim 11, in which the UV-curable urethane comprises a urethane acrylate/acrylate monomer.

13. The invention of claim 11, in which the cured layers comprise layers of UV-curable urethane about 20 microns thick, and in which said layers of UV-curable urethane are cured by a burst of about UV radiation for about 3 second at about 500–600 mJ of intensity.

14. The invention of claim 11, in which the electroluminescent system includes layers originally deployed including an uncured catalyzed vinyl, the catalyzed vinyl including an uncured vinyl vehicle mixed with a catalyst, the catalyst encouraging transformation of the uncured vinyl vehicle to a urethane vehicle during curing thereof.

15. The invention of claim 14, in which the layers originally deployed including an uncured catalyzed vinyl are selected from the group consisting of:

(a) a translucent electrode layer;

(b) a dielectric layer;

(c) an electroluminescent layer; and (d) a non-translucent electrode layer.

16. The invention of claim 14, in which the catalyst comprises polymeric hexamethylene diisocyanate.

* * * * *